US005498383A

United States Patent [19]

Marple et al.

[11] Patent Number: 5,498,383

[45] Date of Patent: Mar. 12, 1996

[54] SLIP CASTING PROCESS AND APPARATUS FOR PRODUCING GRADED MATERIALS

[75] Inventors: Basil Marple; Jean Boulanger, both of Boucherville, Canada

[73] Assignee: National Research Council of Canada, Ottawa, Canada

[21] Appl. No.: 245,003

[22] Filed: May 18, 1994

[51] Int. Cl.[6] ..... B28B 1/26; B28B 13/02

[52] U.S. Cl. ..... 264/87; 264/122; 425/84; 425/130; 425/425; 425/435

[58] Field of Search ..... 264/86, 87, 311, 264/112, 113, 114, 122; 425/84, 85, 130, 425, 435

[56] References Cited

U.S. PATENT DOCUMENTS

| | | | |
|---|---|---|---|
| 1,693,429 | 11/1928 | Austin | 264/86 X |
| 2,288,661 | 7/1942 | Wadman | 264/86 |
| 2,962,790 | 12/1960 | Daniel | 264/86 X |
| 4,252,759 | 2/1981 | Yannas et al. | 264/86 |
| 4,798,694 | 1/1989 | Sugata et al. | 264/86 X |
| 5,167,813 | 12/1992 | Iwata et al. | 264/86 X |

*Primary Examiner*—Karen Aftergut
*Attorney, Agent, or Firm*—Juliusz Szereszewski

[57] ABSTRACT

A slip casting process and apparatus for producing parts with graded properties across the thickness of the body of the parts. A number of slips is combined at a varying predetermined ratio and passed continuously through a casting mold between its inlet and outlet. The process can be carried out under elevated pressure. The casting mold can be positioned vertically or horizontally.

16 Claims, 7 Drawing Sheets

SLIP CASTING PROCESS AND APPARATUS FOR PRODUCING GRADED MATERIALS

FIELD OF THE INVENTION

This invention relates to a modified slip casting process enabling the manufacture of cast products having graded properties throughout the wall thickness of the products, and in particular with continuous gradients of those properties. The invention also encompasses an apparatus for carrying out the process.

BACKGROUND OF THE BACKGROUND

In conventional slip casting, also known as colloidal filtration, molds are filled with slip, i.e. a suspension of fine solid particles in a liquid phase and the latter is removed from the suspension through the walls of the mold leaving the suspended particles behind on the walls. Fresh slip may be added to the mold to replenish the slip that has been removed and ensure that the mold remains full. For solid core casting, this process continues until the part is solid. For hollow core casting, the process continues until the desired wall thickness is achieved, at which point the slip remaining in the mold is poured or drained from the mold. In conventional casting, molds made of plaster of Paris are commonly used. The driving force for casting is the capillary pressure within the network of pore channels in the walls of the mold, the pore channels being of a size smaller than the suspended particles of the slip. As a cast layer of the filtered-out particles builds up on the mold walls, the cast layer itself acts as the filter and the particles continue to deposit.

Various factors affect the rate at which the process proceeds. The properties of the mold, of the suspension (slip) and of the cast layer are all important. For the normal casting of well-behaved slips of constant composition, the thickness of the cast layer is proportional to the square root of time. Various techniques have been used to increase the casting rate, for example pressure casting wherein a pressure is applied on the suspension, or vacuum casting in which the exterior of the mold is subjected to a vacuum. In the conventional casting, as mentioned above, the composition, microstructure and related properties of the cast layer and the resulting part (following the drying and thermal treatment of the cast layer) are uniform throughout.

Graded materials having a gradient in composition and, in some cases, in the microstructure (porosity content, grain size) hold potential for achieving higher performance levels than similar monolithic and composite materials in which the various phases are uniformly distributed. These graded materials are normally most appropriately utilized in applications for which the property requirements at opposite faces of a component differ. However, even in situations where both faces are subjected to similar conditions in service, compositional gradients may be used to enhance the performance. For example, symmetrical grading from both surfaces to the interior can be used to engineer materials containing residual compressive stresses at the surface. Such materials could have improved mechanical strength.

Various methods have been used to produce layered and graded bodies including: tape casting/lamination, see P. Boch et al., J. Am. Ceram. Soc., 69 (8) C-191-C-192 (1986); compaction of graded powders, see R. A. Cutler et al., J. Am. Ceram. Soc., 70 (10) 714–18 (1987), infiltration, see B. R. Marple et al., J. Mater. Sci., 28, 4637–43 (1993); sequential casting, see J. Requena et al. in Ceramic Transactions, Functionally Gradient Materials, Vol. 34, pp. 203–10, American Ceramic Society, Ed. J. B. Holt et al., 1993; electrophoretic deposition, see P. Sarkar et al., J. Am. Ceram. Soc., 75(10) 2907–909 (1992); and sedimentation-slip casting, see J. Chu et al., J. Ceram. Soc. Jpn., 101(7) 818–20 (1993). In some cases, these processes are suited for the production of only very simple geometries or limited to producing layered materials having a stepwise change in composition. The abrupt interface present between the zones in some layered or laminated materials may have a very positive effect on the behaviour of the material (for instance on the crack propagation). However, such interfaces are sometimes undesirable as may be the case where a difference in the coefficient of thermal expansion across the boundary leads to cracking. In these cases, a continuously graded material having a smooth transition in composition through the body may be preferred.

Accordingly, it is the object of the present invention to provide a process useful for making parts, usually ceramic parts or elements, with graded properties, rather than constant or abruptly changing properties, across the thickness of the part.

It is another object of the invention to provide an apparatus for making parts, especially ceramic parts, with graded properties as explained above.

It is still another object of the invention to provide a process and apparatus for making parts with continuously graded properties using the principle of slip casting.

It is yet another object of the invention to provide a controllable process and apparatus for making slip cast parts having predetermined properties.

SUMMARY OF THE INVENTION

According to the invention, there is provided a process for making porous bodies of particulate material with graded properties across the thickness of the bodies, the process comprising the steps of:

a ) providing at least one source of a slip comprising the particulate material, b) passing the slip substantially continuously through a filtering mould having an inlet and an outlet in conditions suitable for the formation of a predetermined layer of the particulate material within said mould, and c) separating said layer from said mould.

Preferably, at least two sources of dissimilar slips are provided, and the process comprises the step of mixing the slips before passing the resulting stream through the mould.

There is also provided an apparatus for carrying out the process of the invention, the apparatus comprising:

at least one source of a slip, a filtering mould having an inlet and an outlet, and supply means associated with said at least one source of slip and the inlet of the mold for passing said slip substantially continuously through said mold from the inlet to the outlet thereof.

In a preferred aspect of the invention, the apparatus comprises:

at least two sources of dissimilar slips, mixing means associated with said sources of slips and said mold for mixing said slips in a predetermined ratio to obtain a combined stream thereof, a filtering mold having an inlet and an outlet, and supply means associated with said mixing means for passing said combined stream substantially continuously through said mold.

The mold may be stationary or movable, e.g. rotatable. The process can be carried out under increased pressure.

BRIEF DESCRIPTION OF THE DRAWINGS

The invention will be described in more detail by way of the following description to be taken in conjunction with the accompanying drawings, in which.

DETAILED DESCRIPTION OF THE INVENTION

Figure 1A:
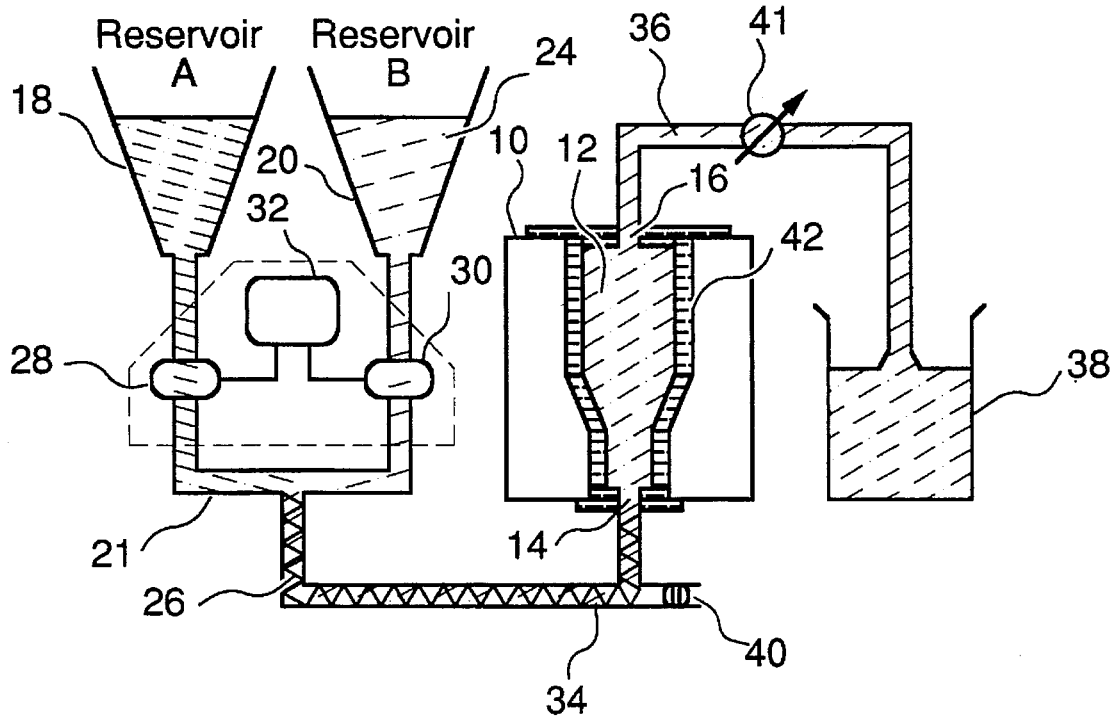
FIG. 1*a* is a schematic of an exemplary apparatus of the present invention, with a stationary mold.

Referring to FIG. 1*a*, an apparatus for graded slip casting has a filtering mold 10 (referred to hereinafter as a mold) defining a cavity 12. The mold 10 has an inlet 14 at its lowermost portion and an outlet 16 at its uppermost portion. This arrangement ensures that a liquid suspension passing through the mold fills practically its entire volume, unless very complicated shapes are involved.

Two slip reservoirs 18 and 20 and tubing 21 are provided to supply selected slips 22 and 24 respectively to a mixing device exemplified by a static mixer 26. The flow ratio of respective slips 22 and 24 can be controlled by adjustable pumps/flowmeters 28 and 30 installed on the tubing 21 so that each pump/flowmeter controls the flow of a separate slip stream. The flowmeters are controlled by a computer-driven control unit 32 which processes a control signal according to a predetermined set of conditions and passes the control signal to the flowmeters 28 and 30.

The mixer 26 is connected to the inlet 14 of the mold 10 via tubing 34. The outlet 16 of the mold is connected via outlet tubing 36 with an overflow collector 38. The tubing 34 is equipped with a drain 40. An optional pressure regulator 41 is installed on the outlet tubing 36 to illustrate the applicability of the apparatus described for graded pressure casting. A cast layer 42 of relatively uniform thickness is shown as formed within the cavity 12.

Figure 1B:
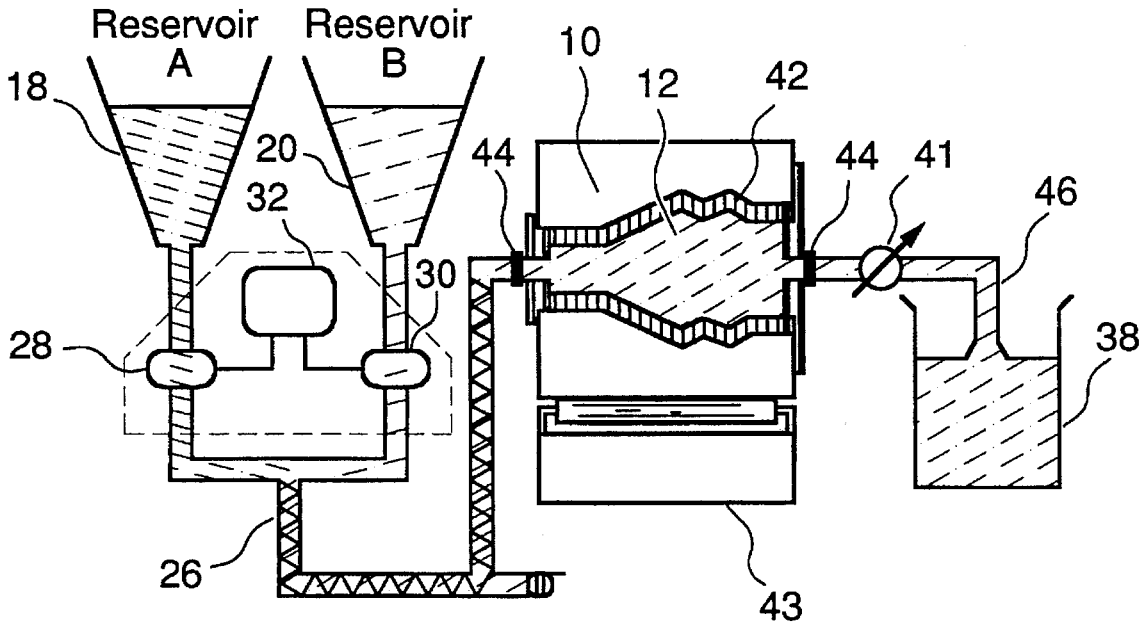
FIG. 1*b* is a schematic of another exemplary apparatus of the invention, with a rotatable mold.

An alternative embodiment of the apparatus of the invention is illustrated in FIG. 1*b* in which like reference numerals correspond to like or similar elements as in FIG. 1*a*. The mold 10 is positioned so that the flow between the inlet 14 and the outlet 16 of the mold is essentially or approximately horizontal. The mold is rotatably mounted on a roller 43. Slip rings 44 are provided to allow for a sealed flow of the slip into the mold 10 and of the excess slip from the mold 10 through a stationary tubing 46 into an overflow collector 38.

Figure 1C:
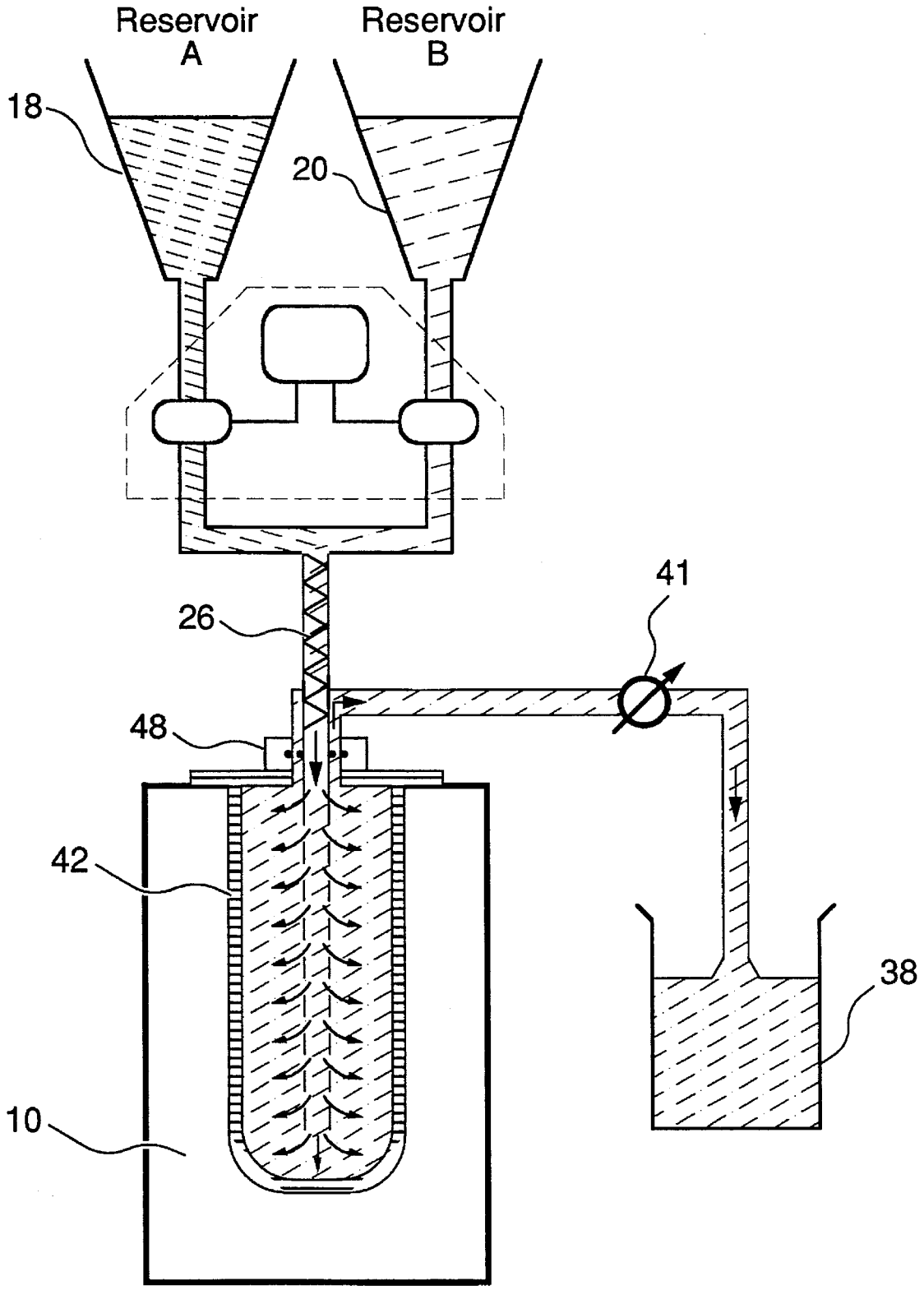
FIG. 1*c* is a schematic of still another exemplary apparatus of the invention with inlet and outlet in the same region of the mold.

It is not essential that the inlet of the mold in the stationary mold version of the invention be positioned at the lowermost portion of the mold. As shown in FIG. 1*c*, both the inlet and outlet of the mold can be situated at the same end of the mold, or in the same portion thereof. Arrows in FIG. 1*c* indicate the flow of slip between the inlet and the outlet of the mold. While FIG. 1*c* shows a stationary mold, the apparatus of FIG. 1*c* can be adapted to handle a rotatable mold if slip rings 48 are used. It is also possible to employ pressure casting with the apparatus of FIG. 1*c*, similarly as in the case of the embodiments of Figs 1*a* and 1*b*, if appropriate means for increasing the pressure of the incoming slip stream are incorporated into the system.

The embodiment of FIG. 1*c* is particularly useful to produce parts with one end closed.

The exact configuration and orientation of the mold during casting and during subsequent draining will depend on the geometry of the mold and the position of the inlet and outlet ports. It is important that, during the casting step, the slip have access to all sections of the mold and that no pockets of air become trapped in unvented portions of the mold. For draining, care must be taken to ensure that all the excess slip can be drained from the mold. This is true regardless of which of the three configurations shown in FIGS. 1*a*, 1*b* and 1*c* is being used. To ensure that draining is complete it may be necessary to tilt or completely invert the mold during the draining step. This may be done manually or by mechanical means. To facilitate movement of the mold, flexible tubing and quick disconnect fittings can be used.

Although only two reservoirs are shown in FIGS. 1*a*–1*c*, the number is not limited and depends on the desired properties of the product.

As in conventional slip casting, the molds can be fabricated from the plaster of Paris, porous plastic or any other material of a porosity such as to enable the filtering of the liquid phase while preventing the entry of the solid phase (suspended particles). For the purpose of the present application, the term mold will be used to designate such filtering molds.

The slips may be prepared using water or another suitable liquid, e.g. ethanol or methanol, or their mixture, as the liquid phase. A wide range of materials can be used as the solid phase of the slip, including ceramics, metals and plastics. The slips can consist of particles of a size smaller than 0.1 μm and as large as 100 μm. In fact, the factor controlling the suitability of any particular material and its particle size distribution for the process of the invention, as for conventional slip casting, is the stability of the suspension. Because of the continuous movement of the suspension in the mold and the continuous stirring in the mixer plus optional stirring in the reservoir(s), the stability of the suspension (slip) is less an issue in the process of the invention than in the conventional casting where the slip remains undisturbed in the mold for a period of time and settling can be a problem. Of course, the lower limit of the particle size depends on the porosity of the mold walls.

Many of the same considerations which apply to the preparation of slips for traditional slip casting are still applicable for graded casting. In aqueous suspensions, the pH is often used to aid in controlling the stability of the suspension. Small amounts of other chemicals are sometimes added. These include, dispersants to aid in dispersing the particles in the suspension, anti-foam agents to assist in removing air and eliminate bubbles so that defects in the form of entrapped gas do not appear in the cast body, and binders which may be used to give more strength to the green part (i.e. the cast part before densification). The solids loading (amount of solid phase in the suspension) can vary over a wide range. There is really no lower limit other than that dictated by the requirements of the cast part. Very dilute suspensions of less than 1% by volume can be used. The upper bound will be determined, in part, by the stability of the suspension. At the present time, a practical upper bound for many systems is approximately 50% by volume. However, the present invention can be used with more highly loaded systems if desired. The solid phase in these suspensions may have a form of particles, platelets, whiskers or fibers. For practical reasons, the density of the particles should be higher than the liquid in which they are suspended or appropriate measures taken to ensure that they stay in suspension and do not float to the top.

The embodiment of FIG. 1*b*, with a horizontal or approximately horizontal mold, is particularly useful for the production of parts having complex geometries with sections in which pockets of stagnant slip could develop. This design can also serve to limit the amount of slip required for the fabrication process since, unlike in the vertical mold version of FIG. 1*a*, it is no longer necessary to completely fill the mold. This can be quite important when large parts are being fabricated.

The rotating mold embodiment can be combined with centrifugal casting wherein a mold is filled with slip and spun in order to increase the gravitational forces. For that purpose, of course, the slip must be contained in the cavity with closing means, not shown.

The flow rate from the particular reservoirs and the overall flow rate through the mold is controlled during casting. There is no lower limit on the flow rate and, in fact, it could be completely stopped if a layer of constant composition were being cast. The upper limit of the flow rate can be determined experimentally by monitoring the effect of the flow rate on casting. At high flow rates, the movement of the slip will interfere with the casting process and as the flow is increased to still higher levels, erosion of the cast layer may occur. The flow rate at which these processes occur depends on the materials being cast. It has been shown for aqueous alumina slips having a pH of 5 and containing 38.6 vol. % solids having a median particle size of 0.3 μm that linear flow rates of 61 cm/min had no effect on the casting rate. Higher flow rates were not tested so it is not yet known at which point problems may arise. Linear flow rates of 60 cm/min are higher than will be required for many applications. For a given application, the flow rate which will be required will be dictated by the change in composition or microstructure which is being produced across the sample. If bodies are being cast in which the change in composition through the thickness must be steep, then, to increase the response time of the process, more dilute suspensions can be used which will have lower casting rates and therefore require lower flow rates to achieve the same sensitivity to changes in slip composition at the flow meters as suspensions having higher concentrations. This approach should alleviate most flow-rate related problems.

The flow rates from the various reservoirs and hence the overall flow rate through the mold can be controlled by computer-driven pumps or, as in the embodiments described herein, pumps/flowmeters. The flow rates which are required are dictated by the slip composition, the casting rates and the desired composition profile through the cast sample. In each case, the composition of the slips or suspensions in the reservoirs and the profile being sought will be known; however, the casting rates of the various slips must be determined and as well, it must be determined how the casting rate changes with composition as the various suspensions are mixed. Using this information, a computer can be programmed to control the flow rates from the reservoirs to produce a desired profile. For example, in the simplest case, if two suspensions A and B were being cast and if both the slips separately and combined in any ratio had the same casting constant, then to produce a linear profile through the thickness of the sample from 100% A to 100% B, the composition of the slip flowing through the mold would need to be changed in a parabolic fashion, i.e.

$$V_A = 1 - \left(\frac{t}{t_f}\right)^{1/2} \quad (1)$$

$$V_B = \left(\frac{t}{t_f}\right)^{1/2} \quad (2)$$

where $V_A$ and $V_B$ are, respectively, the volume fraction of slip A and slip B in the fluid stream entering the mold, t is the time at any point and $t_f$ is the total time required to achieve the desired thickness.

Because of a continuous flow of slurry through the mold, the slip must be collected as it exits the mold. At the end of the cast, the composition of this composite slurry can be readily determined by noting the amount of slurry that has flowed through each pump, by measuring the volume of slurry used from each reservoir or by chemical analysis of the composite suspension. This new combined slurry (slip) can then be reused in subsequent casting trials either to produce homogeneous composite bodies by conventional slip casting or used in an existing reservoir for graded casting.

Following the casting step, treatment of the cast bodies is similar to that normally used in slip casting. Bodies are left in the mold for several minutes to hours, depending on the material and the size of the component, to dry. The mold is then disassembled and the part removed. It is left for further drying either under ambient conditions (relative humidity and temperature) or under controlled conditions. This drying is normally completed in an overnight period but for very large parts it may take days. Following drying, the part undergoes a thermal treatment which will depend on the composition of the cast body and the desired properties of the fired body. For samples containing an organic component such as a binder, this thermal treatment will normally include a heating step (often 25° C.–600° C.) during which the heating rate is very slow (5°–20° C./h). It may be carried out in an atmosphere of air or in other environments such as nitrogen, argon or under vacuum. Heat treatment at higher temperatures will again depend on the material. For example, for oxide ceramics, if a dense final product is desired, samples will typically be heated in air to a temperature in the range of 1400° C.–1700° C. Heating rates vary but are normally 1° C./min– 10° C./min.

Experimental

Slips were prepared using 3-mole %-$Y_2O_3$-stabilized $ZrO_2$ (TZ-3YS, Tosoh, Tokyo, Japan) and $Al_2O_3$(RC-HP DBM, Reynolds Metals Co., Richmond, Va.). The percentage of solids in the alumina, zirconia and composite slips was maintained at 38.6% by volume and a pH value of 5 was typical for all slips. Molds were produced by mixing water and plaster of Paris (No. 1 Pottery Plaster, United States Gypsum Co., Voorhees, N.J.) in a weight ratio of water to plaster of 73:100 (consistency of 73).

The excess slip that flowed from the mold was collected and reused in subsequent casting trials after determining its composition. Following casting, the cast bodies were removed from the mold, allowed to dry overnight at room temperature and sintered at 1500° C. for 2 hours.

Sintered samples were sectioned and polished for microstructural and compositional analysis. To accent the grain junctions, samples were thermally etched by heat treatment at 1450° C. for 15 min. Analyses were performed using a scanning electron microscope (JSM-6100, JEOL Ltd., Tokyo, Japan) equipped with an energy dispersive X-ray (EDX) analysis system. Images of the microstructure were obtained using the secondary electron signal or in the mixed mode, using a combined secondary electron/back-scattered electron signal. To determine the compositional change across samples, EDX analysis was performed at 100 μm intervals over the surface. For each point, an area of approximately 40 μm×50 μm was analyzed.

Figure 2:
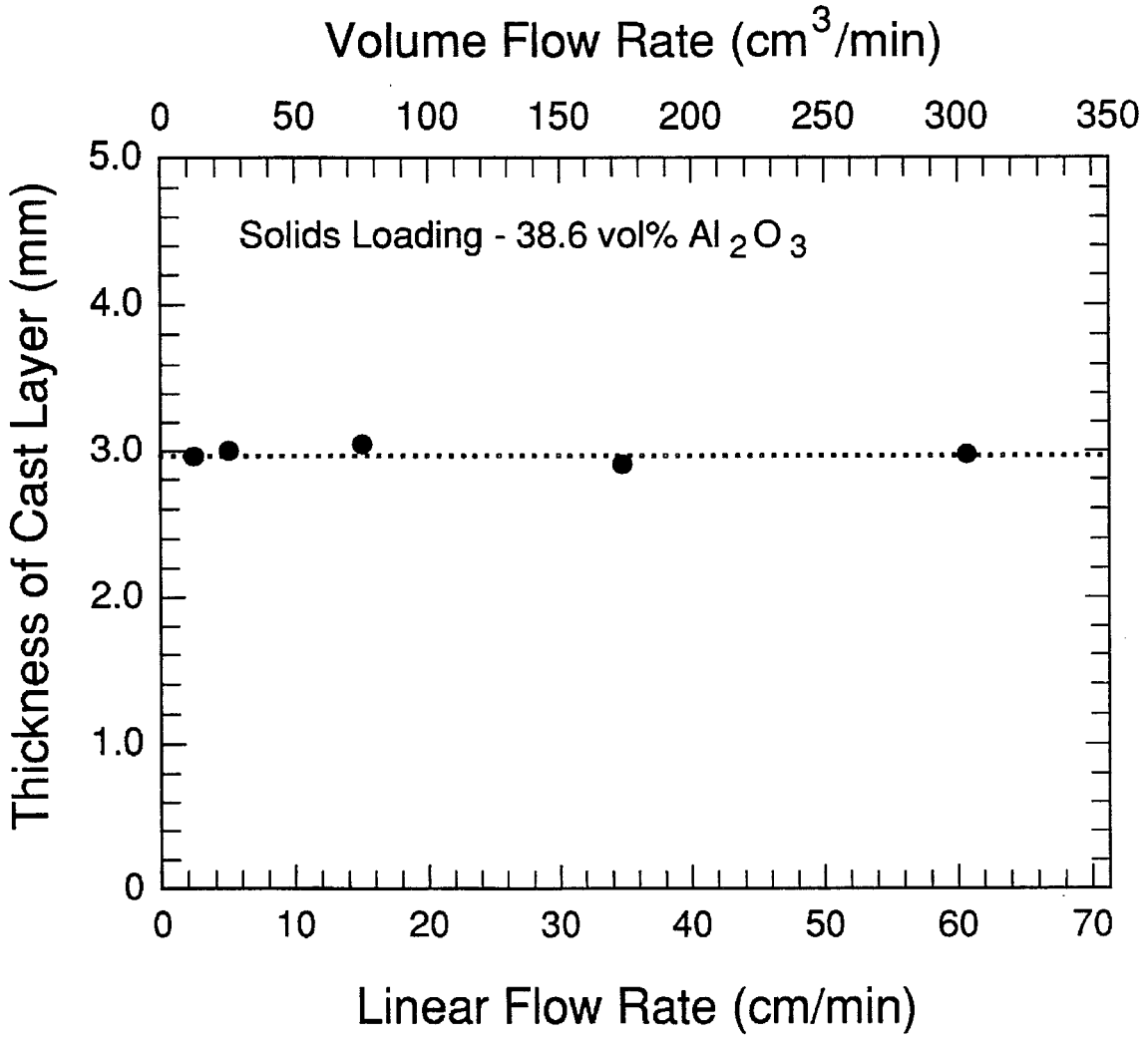
FIG. 2 illustrates an effect of the flow rate of slip through the mold on the thickness of the cast layer.

FIG. 2 illustrates the results of tests conducted to determine the effect of flow through the mold on the quality of the cast. The tests were carried out using an $Al_2O_3$ slip and no attempt was made to change the composition during casting. The total casting time was the same for each flow rate. The results indicate that, for the conditions employed in these trials, the flow did not affect the final thickness of the cast layer. It should be noted that at the highest flow rate tested (a linear flow rate at the wall of 61 cm/min or a volume flow rate of 300 $cm^3$/min), a sufficient amount of slip was entering the mold to completely replace the existing slip every 7 seconds.

These results are important for two reasons. Firstly, in order to ensure a rapid response to changes in concentration, particularly with concentrated slips and fast casting rates, a sufficiently high flow rate will be required. The highest flow rates tested in this work are probably faster than would normally be required to ensure sensitivity of the process to changes in slip composition. Secondly, because in some cases molds will be used in which the cross-section may vary from point to point, it is important that the change in linear flow rate which will occur in such molds not result in differences in wall thickness in the different sections. For cylindrical cavities, a decrease by a factor of two in the diameter of the circular cross-section will result in a four-fold increase in the linear flow rate. Therefore, mold design will play an important role in determining the conditions which are used for casting.

It is important to note that as the flow rate is increased to higher values, one would expect to reach a point where the casting process would be affected and the casting rate reduced. Due to the abrasive nature of ceramic slips, if the flow rate were increased still further, it is reasonable to predict that the flowing slip would begin to erode some of the previously cast layer. In cases where such problems arise, steps could be taken to reduce the casting rate by, for example, changing the properties (reduced level of porosity, slower absorption rate) of the mold or reducing the solids content in the slip. With such changes, lower flow rates could be used and the sensitivity of the response to changes in slip composition maintained.

The conditions used for three of the casting trials carried out during the test program are presented in Table 1. These casting trials were conducted using a linear change in the composition of the slip flowing through the mold during the 8 minute grading portion of the casting. If both slips and the resulting mixture had identical casting properties, such a change would have been expected to produce a parabolic composition profile since the thickness of the cast layer is proportional to the square root of the casting time.

Figure 3:
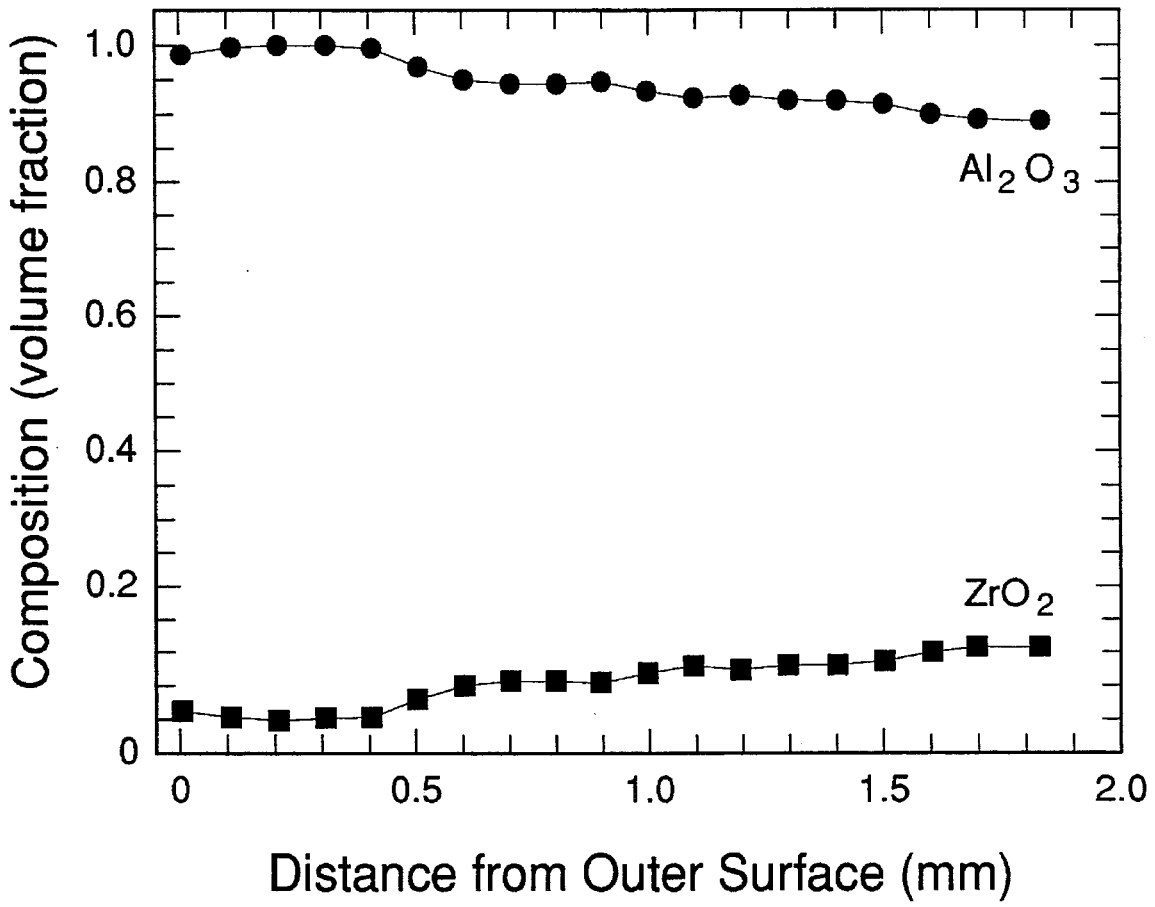
FIG. 3 illustrates the concentration profiles obtained in a trial run No. 1 of the process of the invention.
Figure 4A:
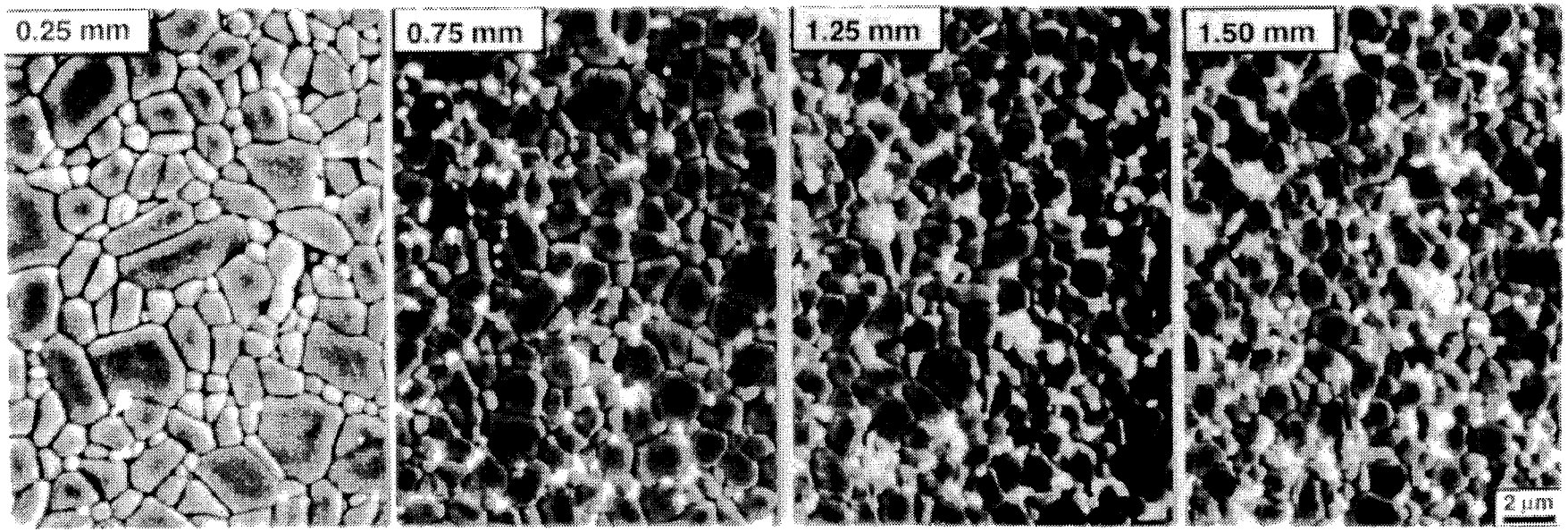
FIG. 4*a* illustrates the microstructure at various locations within the composite obtained in a trial run (No. 2) of the process.
Figure 4B:
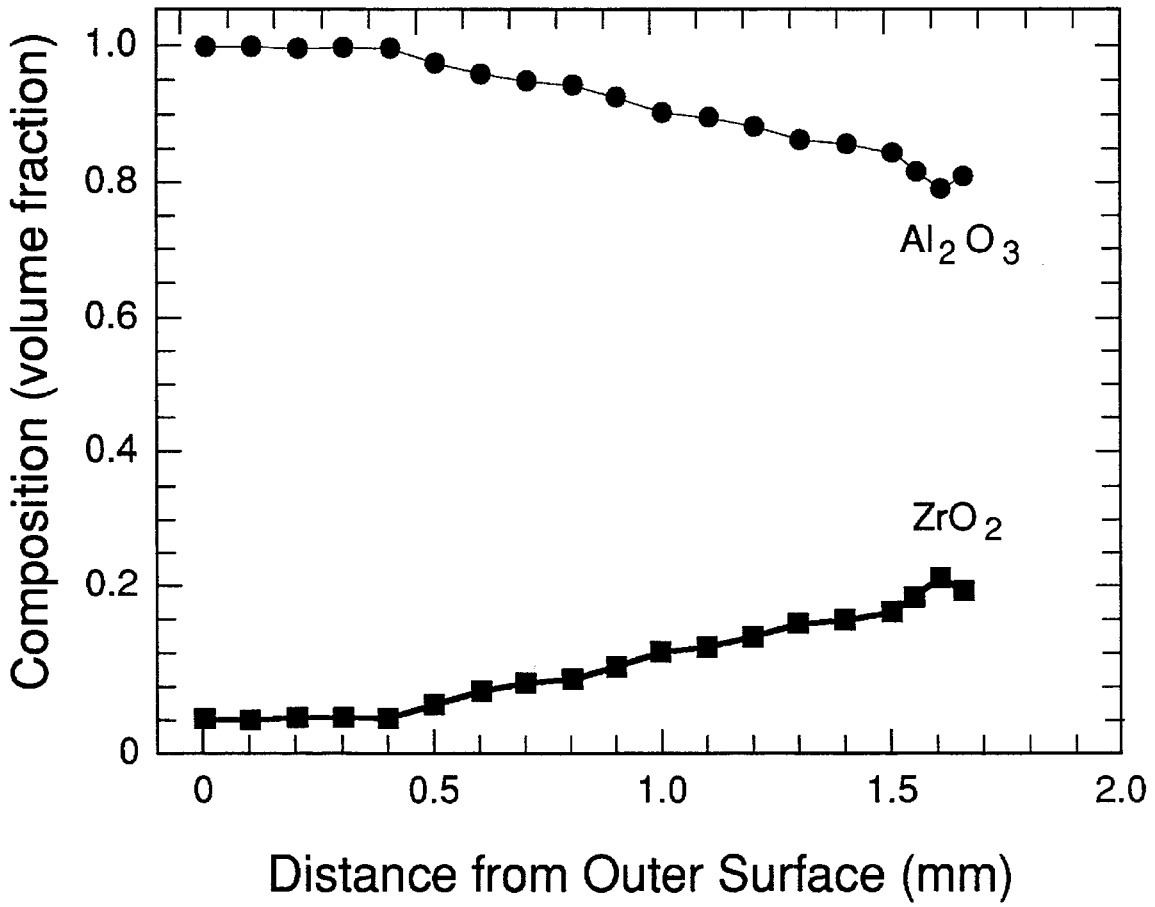
FIG. 4*b* shows the concentration profiles obtained in the trial run No. 2.
Figure 5:
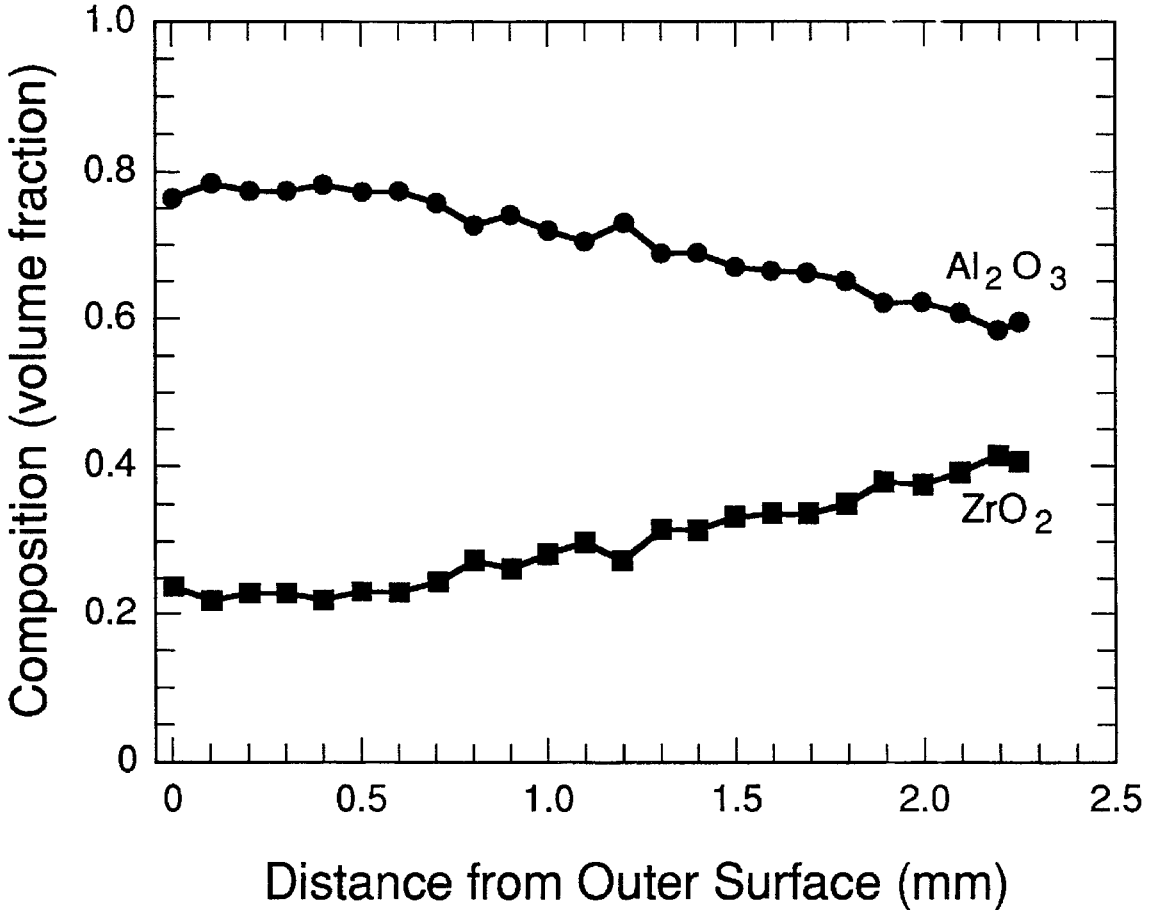
FIG. 5 shows the concentration profiles obtained in the trial run No. 3.

Results of the EDX analysis of the samples produced in these three trials are presented in FIGS. 3, 4*b* and 5 respectively. These results indicate a relatively smooth change in composition through the wall of the component. In all three trials, the composition of the inner surface of the cast body was very close to the final composition of the slip entering the mold. This indicates that changes in slip composition at the flow meters were rapidly reflected in the composition of the cast layer.

Micrographs of one of the three sintered samples (Run No. 2 of Table 1) are presented in FIG. 4*a*. In these micrographs, alumina appears as the darker phase. The location noted on each micrograph represents the distance from the outside surface of the sample. The results show that the smaller zirconia grains are relatively well distributed within the alumina matrix; however, in some cases small clusters or groups of zirconia grains are present. This may indicate that the zirconia has not been completely dispersed in the original slip. In general, however, the micrographs confirm that one of the objects of the invention, i.e. the production of continuously graded elements, with a relatively smooth transition in composition across the bodies, has been achieved.

While only alumina-zirconia composite samples were produced in the tests, it is quite reasonable to expect, based on the scientific principles, that a variety of other graded composites can be obtained using the process and apparatus of the invention.

TABLE 1

| Conditions for Preparing Samples by Graded Casting | | | | | | |
|---|---|---|---|---|---|---|
| | | | Flow rate ($cm^3$/min) | | | |
| Trial | Reservoir | Slip composition* (vol %) | Fill (10 s) | Flush (10 s) | Grade (8 min) | Final Composition (vol %) |
| 1 | A | 100A | 300 | 270 | 45 → 37.5 | 90A/10Z |
| | B | 60A/40Z | 0 | 30 | 5 → 12.5 | |
| 2 | A | 100A | 300 | 270 | 45 → 25 | 80A/20Z |
| | B | 60A/40Z | 0 | 30 | 5 → 25 | |
| 3 | A | 82A/18Z | 300 | — | 45 → 25 | 57A/43Z |
| | B | 32A/68Z | 0 | — | 5 → 25 | |

*A - $Al_2O_3$, Z - $ZrO_2$

The essential feature of the process of the invention is the continuous flow of the slip or a mixture of slips through a mold. Certain advantages can be realized even with a single source of a slip and continuous flow of the slip through the mold, for example if the composition of the single slip is changed over time. For example, slips may be utilized containing agents which undergo a time-dependent chemical reaction which affects the state of dispersion of the particles in the slip and hence the microstructure of the cast layer. The apparatus of the invention clearly lends itself to such an arrangement.

The apparatus and process of the invention allow for the production of composite elements of desired gradients, either continuous or step-wise.

Various modifications of the above-described embodiments may occur to those versed in the art, and such modifications are intended to form part of the invention which is only limited by the scope of the appended claims.

We claim:

1. A process for making bodies with graded properties, comprising a particulate material, the process comprising the steps of:

a) providing at least two sources of at least two dissimilar feedstocks including at least one source of a slip comprising said particulate material, b) combining said at least two dissimilar feedstocks in a predetermined manner to obtain a combined stream thereof, c) passing said combined stream substantially continuously through a slip casting mold having absorbent walls and an inlet and an outlet allowing for flow of said combined stream through said mold from said inlet to said outlet, whereby a first portion of said combined stream is absorbed by said walls thus forming a layer of said particulate material on said walls of said mold, said layer of particulate material having graded properties, d) collecting a second portion of said combined stream at said outlet of said mold, and e) separating said layer from said mold to provide said body of particulate material having graded properties.

2. The process according to claim 1, comprising the steps of:

a) providing at least two sources of dissimilar slips of particulate material, b) continuously combining at least two of said slips to obtain a combined stream thereof, c) passing said combined stream substantially continuously through said slip casting mold to form a predetermined layer of said particulate materials within said mold, said layer having graded properties, and d) separating said layer from said mold.

3. The process according to claim 2 wherein said combining of step b) is carried out to vary a ratio of said slips in a controlled manner.

4. The process according to claim 2 wherein said slips contain particulate materials having dissimilar microstructure.

5. The process according to claim 2 wherein said slips contain particulate materials having dissimilar particle size.

6. The process according to claim 2 wherein at least one of said slips contains an additive.

7. The process according to claim 3 wherein the content of said slips is controlled in a preprogrammed manner.

8. The process according to claim 1 wherein said particulate material comprises a ceramic compound.

9. The process according to claim 1 wherein said slip is passed through said mold under an elevated pressure.

10. A slip casting apparatus for making bodies of particulate material having graded properties, the apparatus comprising at least two sources of at least two dissimilar feedstocks including at least one source of a slip comprising said particulate material, mixing means associated with said sources of said feedstocks for mixing said feedstocks in a predetermined ratio to obtain a combined stream thereof, a slip-casting mold having absorbent walls and an inlet and an outlet for allowing flow of said combined stream through said mold from said inlet to said outlet, whereby a first portion of said combined stream is absorbed by said walls to form a layer of said particulate material having graded properties on said walls of said mold, supply means associated with said mixing means and connected to said inlet of said mold for passing said combined stream substantially continuously through said mold from said inlet to said outlet, and collection means at said outlet of said mold for collecting a second portion of said combined stream.

11. The apparatus of claim 10 wherein said mold is positioned substantially vertically, said inlet being disposed substantially at a lowermost part of said mold and said outlet being disposed substantially at an uppermost part of said mold.

12. The apparatus according to claim 10 wherein said mold is positioned substantially horizontally such that a direction of flow between said inlet and outlet is substantially horizontal.

13. The apparatus according to claim 10 wherein said mold is positioned substantially vertically such that a direction of flow between said inlet and said outlet is substantially upwardly vertical.

14. The apparatus according to claim 10 wherein said mold is positioned substantially horizontally such that a direction of flow between said inlet and outlet is substantially horizontal.

15. The apparatus according to claim 10 further comprising control means for controlling said mixing ratio of said slips.

16. The apparatus according to claim 10 further comprising pressure control means.

* * * * *